US007197903B2

(12) United States Patent
Char et al.

(10) Patent No.: US 7,197,903 B2
(45) Date of Patent: Apr. 3, 2007

(54) METHOD AND APPARATUS FOR A STORM DOOR MORTISE LOCK INCLUDING AN INTEGRAL CAM

(76) Inventors: Frank Char, 2V Tower 9, Wet Hill Peninsula, Tian Tian, Hong Kong (CN); Huang Xiang Xiang, 388 Feng Quang Row, Chong Xing Town, Guang Doang (CN); Liang Xiao Ming, 28 Tower Nine, Redhill Peninsula, Tia Tam, Hong Kong (CN)

( * ) Notice: Subject to any disclaimer, the term of this patent is extended or adjusted under 35 U.S.C. 154(b) by 0 days.

(21) Appl. No.: 10/011,693

(22) Filed: Dec. 8, 2001

(65) Prior Publication Data

US 2003/0106350 A1 Jun. 12, 2003

(51) Int. Cl.
*E05B 59/00* (2006.01)
*E05B 63/14* (2006.01)

(52) U.S. Cl. ..... 70/107; 70/DIG. 62

(58) Field of Classification Search ..... 70/107–111, 70/DIG. 62
See application file for complete search history.

(56) References Cited

U.S. PATENT DOCUMENTS 1,670,783 A * 5/1928 Schrader
1,979,805 A * 11/1934 Main
2,253,496 A * 8/1941 Cordrey et al.
2,380,708 A 7/1945 Schlage et al.
2,725,960 A * 12/1955 Milone ..... 49/505
2,746,098 A * 5/1956 Cooper et al.
3,039,291 A * 6/1962 Dusing et al. ..... 70/451
3,337,248 A * 8/1967 Russell et al.
3,808,849 A * 5/1974 Alexander ..... 70/149
3,884,056 A * 5/1975 East et al. ..... 70/100
3,917,329 A 11/1975 Fujiki et al. ..... 292/163
3,999,789 A * 12/1976 Maurits et al. ..... 292/34
4,109,494 A * 8/1978 Allemann ..... 70/107
4,129,019 A * 12/1978 Urdal ..... 70/107
4,236,396 A * 12/1980 Surko et al. ..... 70/107
4,272,974 A * 6/1981 Hennessy ..... 70/129
4,276,760 A * 7/1981 Nolin ..... 70/107
4,572,556 A * 2/1986 Foshee ..... 70/107 X
4,578,967 A 4/1986 Yu ..... 70/107
4,683,733 A * 8/1987 Marin ..... 70/134
4,696,174 A * 9/1987 Marks ..... 70/451
4,840,050 A * 6/1989 Gotanda ..... 70/107
4,986,576 A * 1/1991 Anderson ..... 292/40
5,040,393 A * 8/1991 Rossebo ..... 70/370
5,201,200 A * 4/1993 Hauber ..... 70/107
5,339,663 A * 8/1994 Doring ..... 70/379 R (Continued)

*Primary Examiner*—Lloyd A. Gall
(74) *Attorney, Agent, or Firm*—McKee, Voorhees & Sease, P.L.C.

(57) ABSTRACT

A method and apparatus for providing a storm door with a mortise lock that includes a lock body having opposed side plates and a cam in between the side plates, the cam being in operative interaction with a dead bolt assembly. The mortise lock body also includes one or more stops to limit the rotation of the cam and prevent a lockout situation. A thumb turn button and key cylinder are secured to opposite escutcheon plates. A spindle traverses from the key cylinder through the cam through hole and terminates in the mounting slot of the thumb turn button. Rotation of either the thumb turn button or the key cylinder turns the spindle and actuates the cam that actuates the dead bolt assembly.

4 Claims, 9 Drawing Sheets

U.S. PATENT DOCUMENTS 5,634,508 A * 6/1997 Herbst ..... 160/371
5,819,562 A * 10/1998 Christ ..... 70/107
5,881,586 A * 3/1999 Shen ..... 70/107
6,170,305 B1 * 1/2001 Shen ..... 70/107
6,282,929 B1 * 9/2001 Eller et al. ..... 70/109
6,655,108 B2 * 12/2003 Larson et al. ..... 52/784.1
6,688,063 B1 * 2/2004 Lee et al. ..... 52/455
2003/0033839 A1 * 2/2003 Chen et al. ..... 70/107

* cited by examiner

METHOD AND APPARATUS FOR A STORM DOOR MORTISE LOCK INCLUDING AN INTEGRAL CAM

BACKGROUND OF THE INVENTION

1. Field of the Invention

The present invention generally relates to a storm door including a mortise lock and more specifically to a mortise lock for a storm door that includes a mortise lock body having an integral cam.

2. Prior Art

Storm door mortise locks typically have a dead bolt that is activated by an integrally connected key cylinder body. The typical key cylinder body 10 of the prior art, shown in FIG. 1, includes the common mechanics of a standard key cylinder 12 opposite from a thumb turn button 14. The key cylinder 12 and the thumb turn button 14 are connected to a cam 16 within the key cylinder body 10. The cam 16 can be rotated by either turning the thumb turn button 14 or by only by use of the correct key in the key cylinder 12.

The key cylinder body 10 has a profile that makes installation of the prior art mortise locks difficult. Installation of the key cylinder body 10 requires that a rectangular cut be stamped into the face of the door. For simplicity and cost saving reasons, round holes are preferred. However, the unusual shape of the key cylinder body 10 of the prior art would require a round hole with a diameter so large that the hole would require significant additional hardware, such as widened escutcheon plates to cover the hole, making the latch less aesthetically pleasing. Rather than make such a large round hole, currently, a rectangular slot is made on both sides of the door face.

Making this slot requires special tools and is much more difficult, time intensive and expensive than simple drilling. Because of the expense and special tooling required, preparation of current mortise lock cuts is typically done by the storm door manufacturer. The manufacturer would save valuable time and money if the mortise locks could be installed on-site. There is therefore a need for a mortise lock that allows for installation using normal drilling techniques.

The key cylinder body 10 of the prior art is also extremely thick. This limits the minimum width of the storm door. Storm doors are typically installed within the doorjamb in front of the standard door. Therefore, hardware used to operate the storm door, such as the handles, lock buttons, etc., must fit within the narrow gap between the storm door and the standard door. It is desirable to provide a storm door that has a minimum thickness to allow for a greater variety of storm door hardware to be used.

Because the key cylinder body 10 of the prior art was not integrated with the mortise lock body, there is also a danger that a lockout situation could occur. If the cam 16 was over rotated, it would fall out of the notch in the dead bolt assembly when the dead bolt assembly stopped in a position wherein the cam 16 cannot reengage the dead bolt. This could leave the dead bolt engaged without a means to disengage it, commonly known as a lockout situation. This would greatly inconvenience the storm door operator and possibly require the disassembly of the storm door. There is therefore a need for a cam that can be easily stopped from causing a lockout situation.

Further, typical storm doors, using a conventional mortise lock body, allow for the reversal of the storm door, for use in either right or left hand hinges. However, because of the difficulty of installing the mortise locks of the prior art, the only practical way to reverse the storm door is by flipping the door. Flipping the door is burdensome and may not always be aesthetically pleasing. There is therefore a need for a mortise lock that allows the installer to use the door in either right or left hand hinges without flipping the door.

There is therefore a need for a storm door with a mortise lock that avoids these and other problems.

Features of the Present Invention

A general feature of the present invention is the provision of a method and apparatus for providing a storm door with a mortise lock which overcomes the problems found in the prior art.

A further feature of the present invention is the provision of a method and apparatus for providing a storm door with a mortise lock in which the amount of door face preparation and associated costs are minimized.

Another feature of the present invention is the provision of a method and apparatus for providing a storm door with a mortise lock in which the mortise lock may be installed by drilling standard round bore holes.

A further feature of the present invention is the provision of a method and apparatus for providing a storm door with a mortise lock in which the cam is separate from the key cylinder.

A still further feature of the present invention is the provision of a method and apparatus for providing a storm door with a mortise lock in which the cam may be secured within the mortise lock body.

Another feature of the present invention is the provision of a method and apparatus for providing a storm door with a mortise lock wherein the mortise lock is easily reversible.

A further feature of the present invention is the provision of a method and apparatus for providing a storm door with a mortise lock wherein the mortise lock body is a minimum thickness.

A still further feature of the present invention is the provision of a method and apparatus for providing a storm door with a mortise lock that includes built in stops to prevent a lockout situation.

These, as well as other features and advantages of the present invention, will become apparent from the following specification and claims.

BRIEF SUMMARY OF THE INVENTION

The present invention generally comprises a method and apparatus for providing a storm door with a mortise lock. The mortise lock may be either a reversible mortise lock or a solid core mortise lock. The mortise lock includes a lock body having opposed side plates with a dead bolt assembly and a live bolt assembly intermediate the side plates. The bolts slide between retracted and extended positions beyond the edge of the door. A cam is also intermediate the side plates and therefore integral with the mortise lock body. The mortise lock of the present invention also includes a thumb turn button and a key cylinder that are separate from the cam. The thumb turn button and key cylinder are secured to opposite escutcheon plates. A spindle operatively links the key cylinder, cam and thumb turn button. Because these parts are separate, they can be used in storm doors of varying thicknesses by only changing the length of the spindle.

By securing only the cam between the two side plates, the overall thickness of the storm door can be minimized. Further, by having a separate key cylinder, there is greater flexibility in mortise lock configurations. Preferably, the key cylinder of the present invention includes a plurality of pins within the key cylinder housing and in the decorative portion thereof. By locating the pins in the decorative portion of the key cylinder housing, the overall length of the key cylinder is shortened.

Further, the mortise lock body of the present invention may also include a plurality of stops. The stops can be integrally formed in the side plates of the mortise lock body. The stops prevent the cam from over rotating and resulting in a lockout situation.

During installation, a mortise for the mortise lock is made. Next, a conventional drill may be used to make the necessary holes for the key cylinder and thumb turn button. This minimizes both the preparation time required and the associated costs. Further, because installation can now be performed with ordinary drills, installation and door face preparation can be done on-site. This saves the manufacturer valuable time and money when preparing the storm door. These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals indicate corresponding structure throughout the several views.

DETAILED DESCRIPTION OF THE INVENTION

The present invention will be described as it applies to its preferred embodiment. It is not intended that the present invention be limited to the described embodiment. It is intended that the invention cover all modifications and alternatives which may be included within the spirit and scope of the invention.

Figure 1:
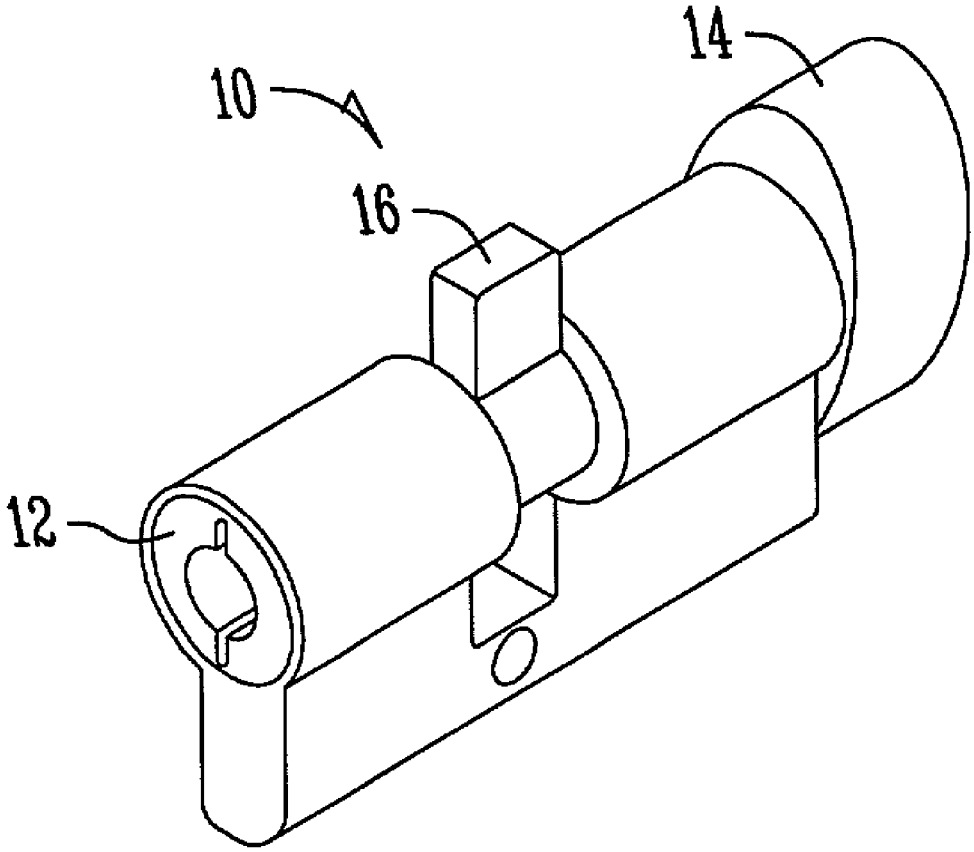
Fig. 1 (PRIOR ART)
FIG. 1 is a perspective view of a prior art key cylinder body.
Figure 2:
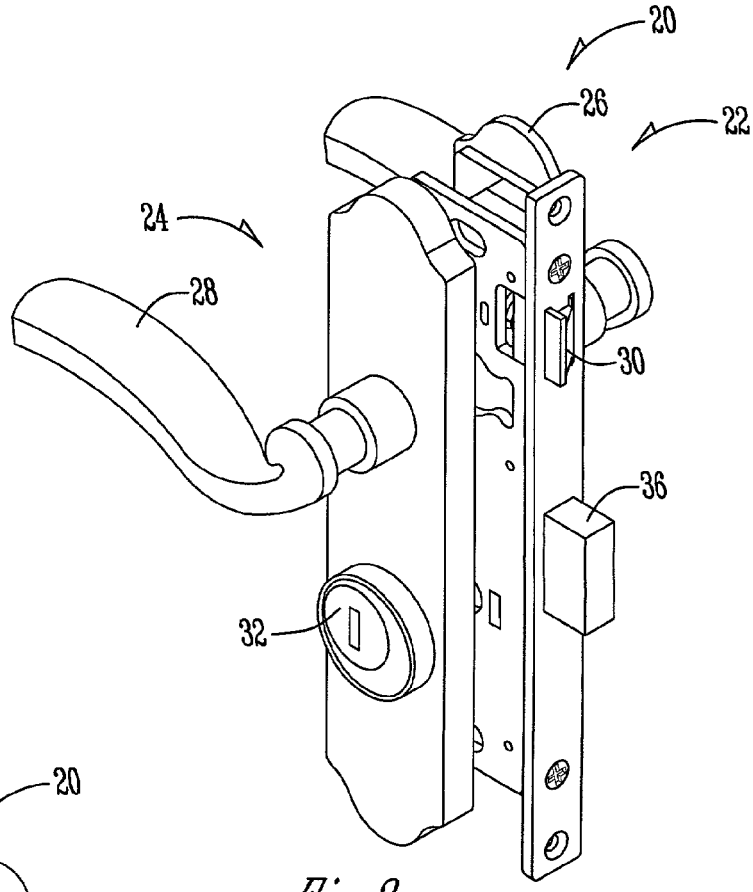
FIG. 2 is a front top perspective view of a mortise lock according to the principles of the present invention.
Figure 3:
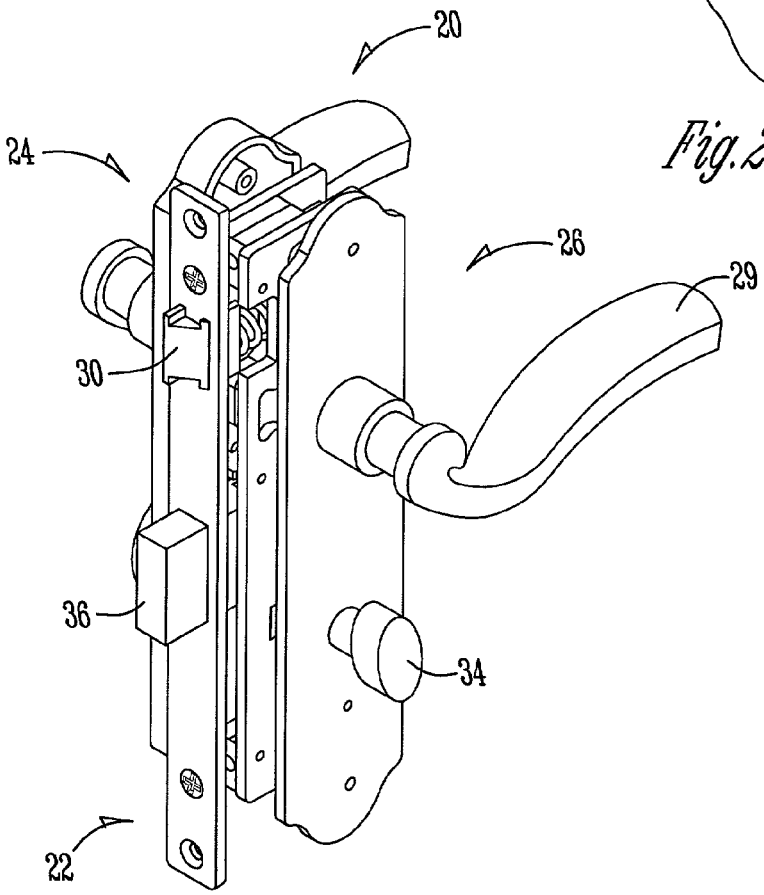
FIG. 3 is a rear top perspective view of the mortise lock shown in FIG. 2.

Referring now to the drawings, wherein like reference numerals and letters indicate corresponding structure throughout the several views, and referring in particular to FIGS. 2 and 3, there is shown a mortise lock 20 according to the present invention. The mortise lock 20 preferably includes a lock body 22, exterior escutcheon assembly 24 and interior escutcheon assembly 26. The exterior escutcheon assembly 24 has a handle 28 to actuate the live bolt assembly 30. The key cylinder 32, used to turn the dead bolt assembly 36, is also part of the exterior escutcheon assembly 24. The interior escutcheon assembly 26 also includes a handle 29 to actuate the live bolt assembly 30. A thumb turn button 34 is also provided to turn the dead bolt assembly 36. The live bolt assembly 30 and the dead bolt assembly 36 are secured to the lock body 22.

The key cylinder 32 of the present invention is separate from and does not include the cam 58. By separating the key cylinder 32 from the cam 58, the cross-sectional profile of the key cylinder 32 can be minimized and the thickness of the mortise lock body 22 can be minimized. The cross-sectional profile of the key cylinder 32 is generally circular. This allows for circular installation holes to be drilled by conventional methods using commonly available tools. Using commonly available tools reduces the overall time and corresponding costs needed to prepare the face of the storm door 18. A spindle 40 is rotatably secured to the key cylinder 32. The key pin or pins are incorporated within the key cylinder housing. This allows the overall length of the key cylinder 32 to be kept to a minimum, thereby making the exposed portion of the key cylinder 32 more aesthetically pleasing. The key cylinder housing also includes one or more channels.

Figure 4:
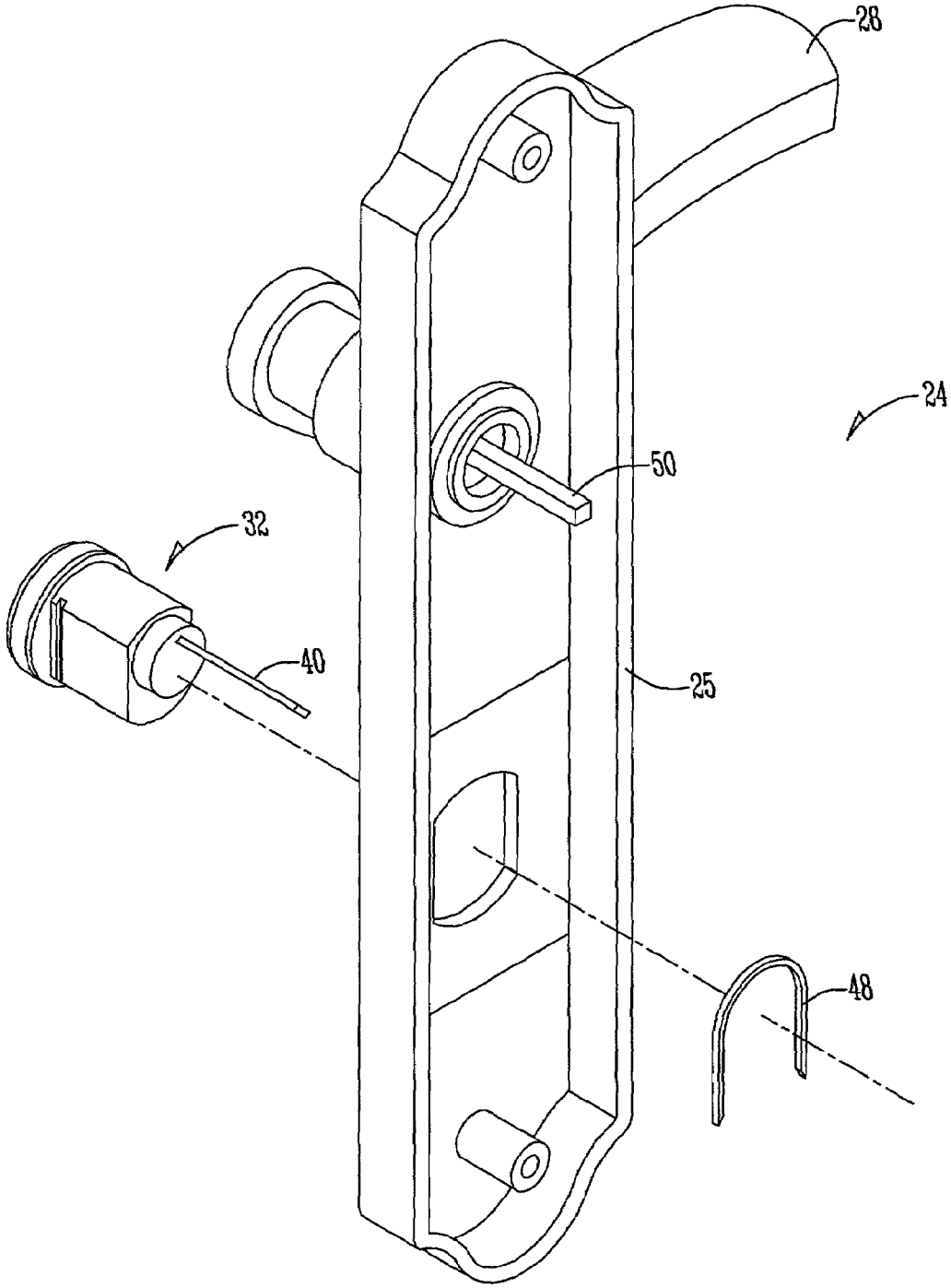
FIG. 4 is a partial exploded perspective view of the exterior escutcheon plate assembly.

The key cylinder 32 is secured to the exterior escutcheon plate 25 as shown in FIG. 4. A retaining clip 48 fits within the channels to hold the key cylinder 32 to the exterior escutcheon plate 25. FIG. 4 also shows the handle spindle 50 installed in the handle 28 of the exterior escutcheon assembly 24.

Figure 5:
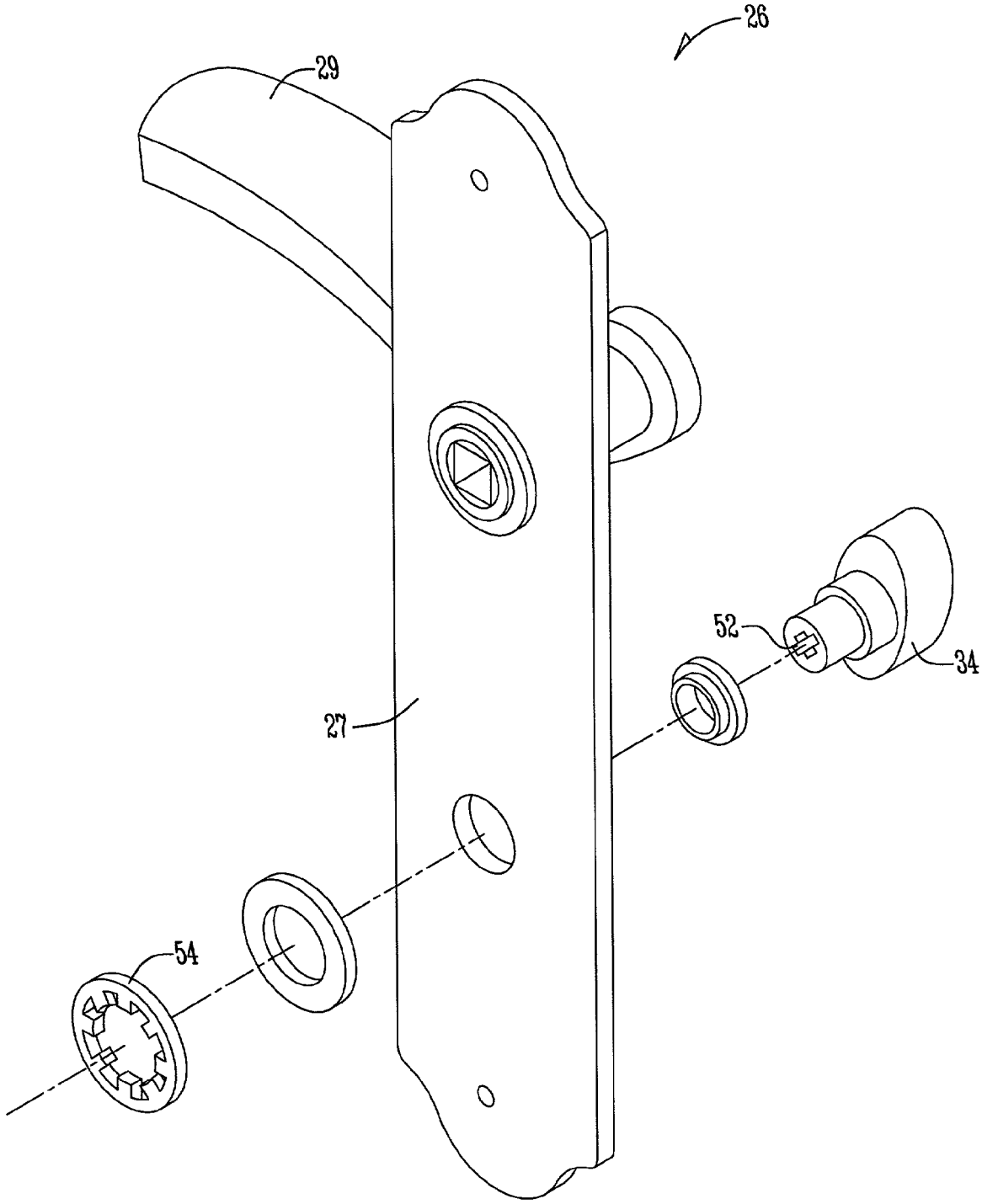
FIG. 5 is a partial exploded perspective view of the interior escutcheon plate assembly.

The interior escutcheon assembly 26 is shown in FIG. 5. The interior escutcheon assembly includes a handle 29 rotatably secured to the interior escutcheon plate 27. The handle 29 is adapted to receive the handle spindle 50 previously installed in the exterior escutcheon assembly 24. The thumb turn button 34 is preferably rotatably secured to the interior escutcheon plate 27 by a retaining ring 54. The thumb turn button 34 includes at least one mounting slot 52 for receiving the spindle 40. By having a plurality of slots 52, the installer can best determine the proper orientation of the thumb turn button 34.

Figure 6:
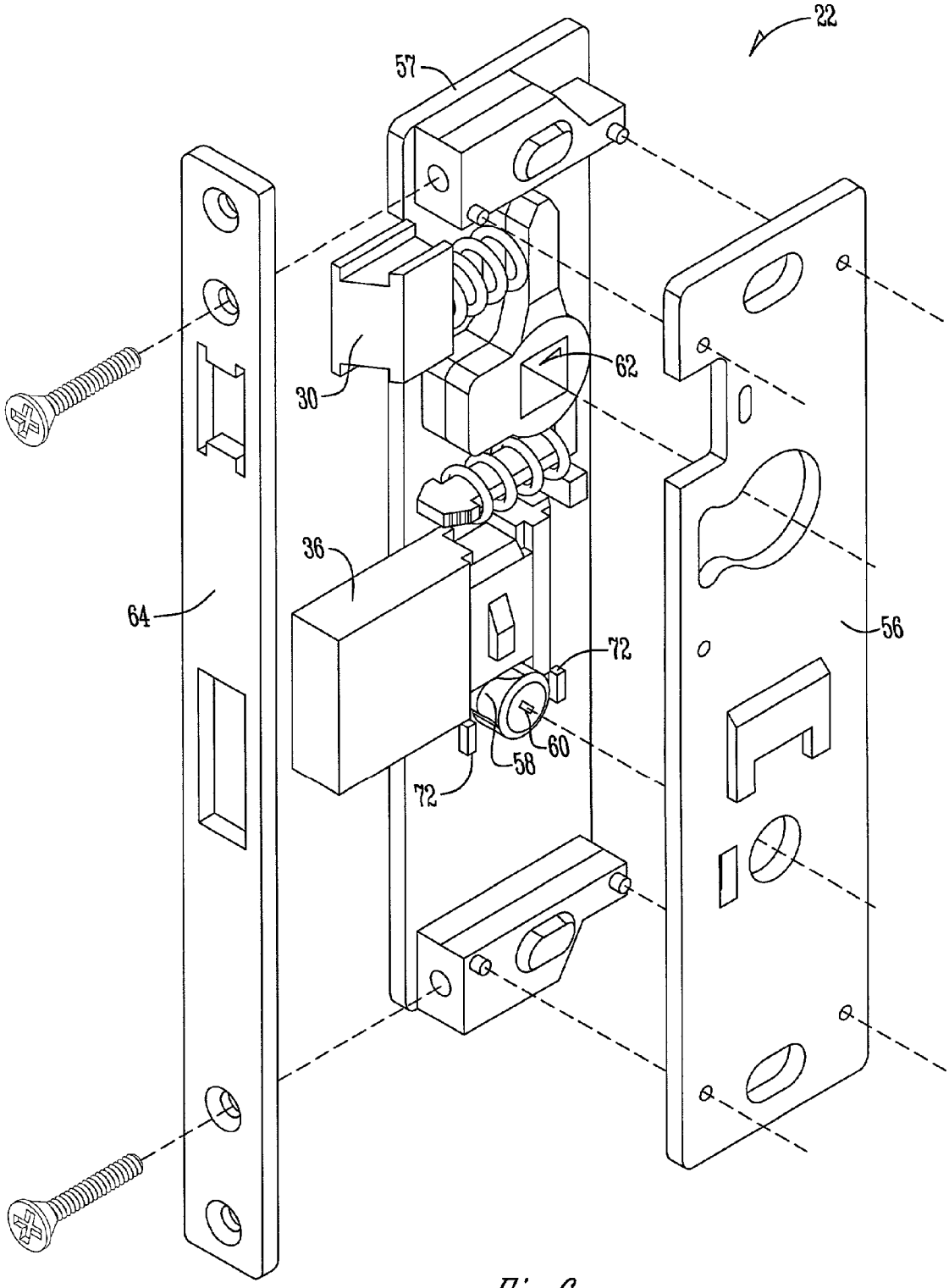
FIG. 6 is a partial exploded perspective view of the mortise lock body of the present invention.

The lock body 22 is shown in FIG. 6. The lock body 22 includes a cam 58 rotatably secured between two side plates 56 and 57. The cam 58 includes a cam through hole 60. When installed, the spindle 40 (shown in FIGS. 4 and 7) passes through the cam through hole 60 and into the thumb turn button 34 (shown in FIGS. 5 and 7) such that turning of either the key cylinder 32, by a corresponding key (not shown), or the thumb turn button 34 will turn the cam 58 and actuate the dead bolt assembly 36.

Figure 7:
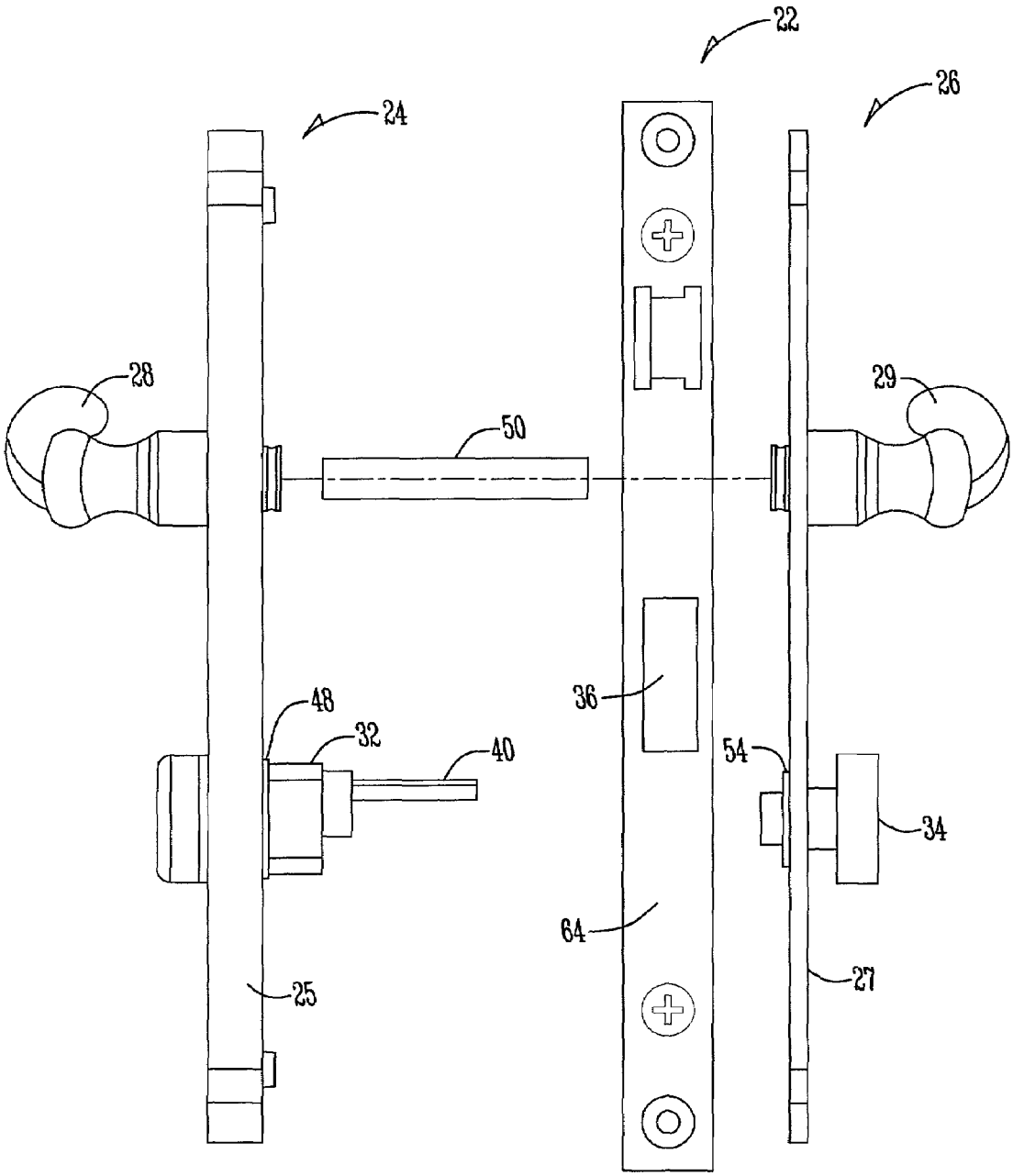
FIG. 7 is a partial exploded side view of the mortise lock of the present invention.

The lock body 22 also includes the live bolt assembly 30 that includes a slot 62 for receiving the handle spindle 50. When properly installed, the handle spindle 50 will be operatively connected to the handle 28 on the exterior escutcheon assembly 24 and the handle 29 on the interior escutcheon assembly 26, such that rotation of either handle 28 or 29 will actuate the live bolt assembly 30. The proper alignment of the lock body 22, the interior escutcheon assembly 26 and the exterior escutcheon assembly 24 is shown in FIG. 7.

Figure 8:
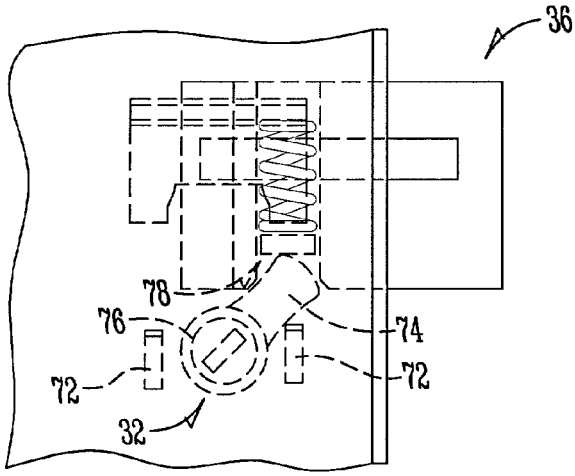
FIGS. 8–10 are side views of the mortise lock body of the present invention during actuation of the cam and deadbolt assembly of the present invention.
Figure 9:
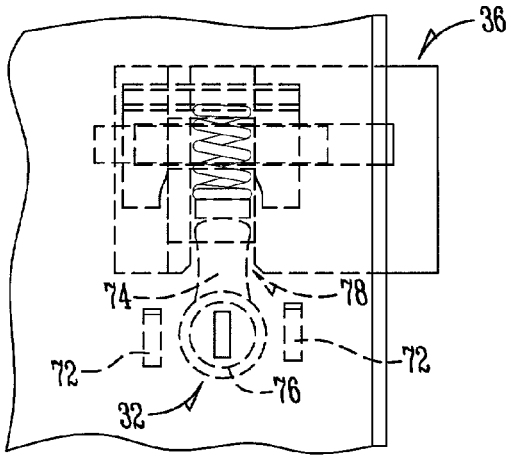
Figure 10:
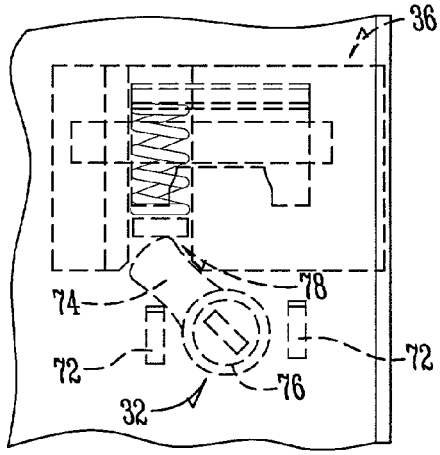

During actuation of the dead bolt assembly 36, the cam 58 will rotate through approximately a 90 degree arc as is shown in FIGS. 8–10. Rotation of the cam 58 is limited by one or more stops 72 formed in or secured to the side plates 56 or 57. The cam generally includes a cam body 76 and a cam arm 74. The cam arm 74 extends axially from the cam body 76 and into a notch 78 in the dead bolt assembly 36. When the cam arm 74 is rotated in one direction the dead bolt assembly 36 is extended and the storm door is secured. When the cam arm 74 is rotated in the opposite direction, the dead bolt assembly 36 is retracted and the storm door may be opened. The stops 72 generally prevent the cam arm 74 from ever losing operative interaction with the notch 78 in the dead bolt assembly 36. This prevents lockout situations.

Figure 11:
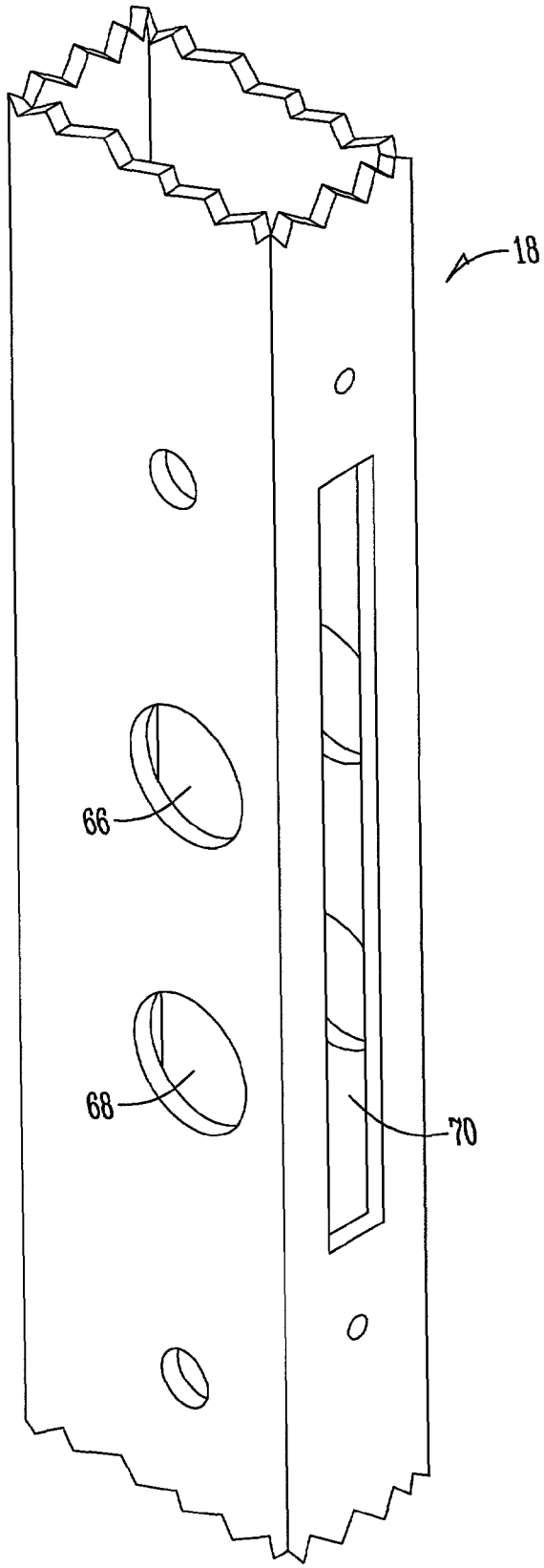
FIG. 11 is a partial perspective view of an edge of a storm door that has been prepared to receive a mortise lock according to the present invention.

Of course the entire mortise lock 20 of the present invention is installed in a properly prepared storm door 18. A properly prepared storm door 18 is shown in FIG. 11. As is shown, there are two round holes on each side or face of the storm door 18. A pair of corresponding handle holes 66 are drilled to allow for the handles 28 and 29 and the live bolt assembly 30 to be operatively connected by the handle spindle 50. There is also a pair of corresponding key cylinder holes 68. The key cylinder holes 68 allow the key cylinder 32, cam 58 and thumb turn button 34 to be operatively connected by the spindle 40. Because the key cylinder 32 has a relatively small cross-section, the key cylinder holes 68 can be easily covered up by standard escutcheon plates 25 and 27.

Figure 12:
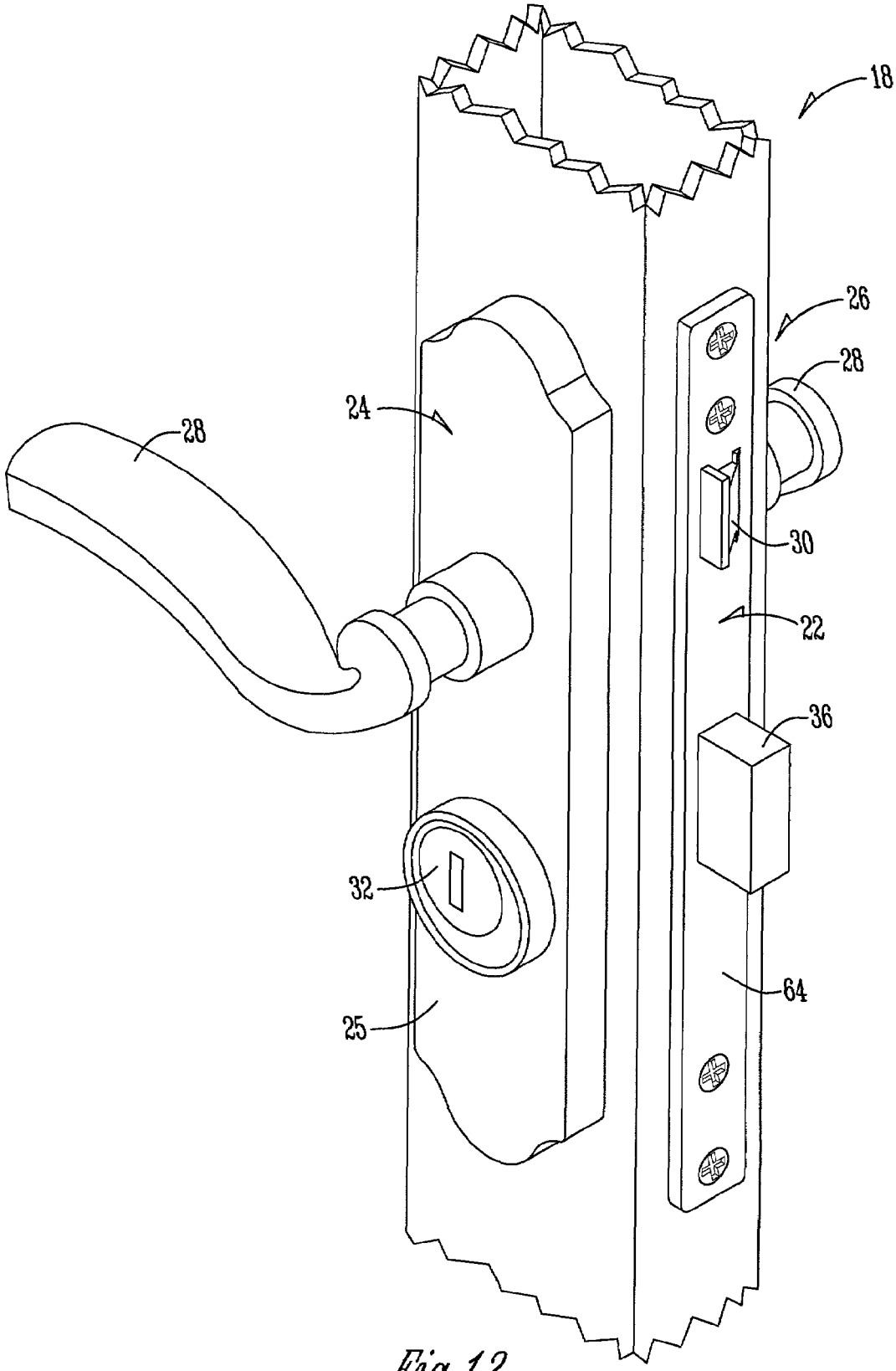
FIG. 12 is a partial perspective view of an edge of a storm door with the mortise lock of the present invention installed therein.

A mortise 70 is also made in the storm door 18 as shown in FIG. 11. It can be appreciated that by integrating the cam 58 into the mortise lock body 22, the width of both the lock body 22 and the corresponding mortise 70 can be minimized. This preparation allows the entire mortise lock 20 to be installed into the storm door 18 as shown in FIG. 12. Preparation can be done easily by an installer on-site to either side of the storm door 18. This allows the storm door 18 to be reversible without the need to flip the storm door.

A preferred embodiment of the present invention has been set forth above. It should be understood by one of ordinary skill in the art that modifications may be made in detail, especially in matters of shape, size and arrangement of parts. Such modifications are deemed to be within the scope of the present invention which is to be limited only by the broad general meaning of the terms in which the appended claims are expressed.

What is claimed is:

1. A storm door comprising:

first and second opposing facing walls joined by sidewalls, with a mortise formed in one of the sidewalls;

a mortise lock fitting within the mortise, and having:

spaced apart first and second side plates;

first and second handles on the first and second side plates;

a first spindle extending between the first and second handles;

a live bolt slidably mounted intermediate the side plates and actuated by the first spindle upon turning of either of the first and second handles for movement between extended and retracted positions;

a key cylinder mounted adjacent the first side plate;

a thumb turn mounted adjacent the second side plate;

a second spindle extending between the key cylinder and the thumb turn;

a rotatable cam mounted on the second spindle between the side plates and being rotatable in opposite directions by turning of either a key in the key cylinder and the thumb turn;

a dead bolt slidably mounted intermediate the side plates and sliding between a locked position and an unlocked position, wherein the cam engages the dead bolt and rotation of the cam in a first direction moves the dead bolt to the locked position and rotation of the cam in a second direction moves the dead bolt to the unlocked position;

first and second stops attached to at least one of the side plates to limit rotation of the cam through approximately a 90 degree arc, the stops preventing the cam from losing operative interaction with the dead bolt.

2. The storm door of claim 1 further comprising a hole in the cam for receiving the second spindle.

3. The storm door of claim 1 further comprising a hole in the cam through which the second spindle extends.

4. The storm door of claim 1 wherein the cam resides between the key cylinder and the thumb turn.

* * * * *